US007503826B2

(12) United States Patent
Howard

(10) Patent No.: US 7,503,826 B2
(45) Date of Patent: Mar. 17, 2009

(54) FLYING APPARATUS

(76) Inventor: David Howard, 3625 Sunflower Cir., Longmont, CO (US) 80503

( * ) Notice: Subject to any disclaimer, the term of this patent is extended or adjusted under 35 U.S.C. 154(b) by 449 days.

(21) Appl. No.: 11/425,971

(22) Filed: Jun. 22, 2006

(65) Prior Publication Data

US 2006/0292957 A1 Dec. 28, 2006

Related U.S. Application Data

(60) Provisional application No. 60/692,807, filed on Jun. 22, 2005.

(51) Int. Cl.
*A63H 27/18* (2006.01)
*A63H 27/00* (2006.01)

(52) U.S. Cl. ..... 446/34; 446/61; 244/153 R; 244/154

(58) Field of Classification Search ..... 446/30, 446/31, 34, 61–68; 244/120, 123, 124, 153 R, 244/154, 155 R
See application file for complete search history.

(56) References Cited

U.S. PATENT DOCUMENTS 1,497,774 A * 6/1924 Dowd ..... 446/61
2,593,979 A * 4/1952 Calhoun ..... 244/154
2,827,252 A * 3/1958 Pohl ..... 244/154
2,870,569 A 1/1959 Bergstrand et al.
3,093,354 A * 6/1963 Pohl ..... 244/154
3,935,664 A * 2/1976 Neuhierl ..... 446/34
4,003,155 A * 1/1977 Raskin ..... 446/67
4,099,690 A * 7/1978 Mendelsohn ..... 244/153 R
4,228,977 A * 10/1980 Tanaka ..... 244/153 R
D260,787 S 9/1981 Tanaka
4,494,940 A * 1/1985 Gretz ..... 446/61
6,217,404 B1 4/2001 Liao
6,425,794 B1 * 7/2002 Levy et al. ..... 446/34
D469,144 S 1/2003 Greenberg
6,685,528 B1 2/2004 Harvey

* cited by examiner

*Primary Examiner*—Kien T Nguyen
(74) *Attorney, Agent, or Firm*—Greenlee Winner and Sullivan, PC

(57) ABSTRACT

This invention provides a small lightweight glider that is hollow and made from a molded thin film material. Typically the glider is formed in the shape of a bird or a plane. The body of the glider comprises top half and a lower half, which form a hollow fuselage, a left wing and a right wing extending laterally from the fuselage. The glider also comprises a ballast weight, a stiffener, and optionally an interior skeleton. The interior of the glider is open to the outside atmosphere and requires no inflation.

17 Claims, 6 Drawing Sheets

FLYING APPARATUS

CROSS REFERENCE TO RELATED APPLICATIONS

This application claims priority from U.S. Provisional Patent Application No. 60/692,807 filed Jun. 22, 2005, which is incorporated herein by reference.

BACKGROUND OF THE INVENTION

Flying toys have been associated during the growth of a child for amusement, co-ordination of eyes to hands, emotions and the like for many years. Paper planes, balsa gliders, and other materials such as plastics have been used to construct toys for the purpose of launching into the air as gliders. Various designs for gliders exist in the prior art. U.S. Pat. No. 2,870,569 (Jan. 27, 1959 to Bergstrand et. al) teaches a hollow model airplane with an elongated fore-and-aft semi-tubular fuselage halves having opposite marginal edges adjoining to form an elongated hollow fuselage and an internal stiffener of relatively more rigid sheet material. U.S. Pat. No. 4,003,155 (Jan. 18, 1977 to Raskin) teaches a toy glider that has rib elements for defining its wing structure completed with an outer covering of light material stretched around and adhered to open corrugations to make the rib wing structure. U.S. Pat. No. 6,217,404 B1 (Apr. 17, 2001 to Liao) teaches a glider toy airplane made from a foldable fuselage with weight blocks (ballast), wing and tail slots, a wing and tail penetrating through said slots, a tail fin fitting into a groove held together with adhesive sheets. U.S. Pat. No. 6,685,528 B1 (Feb. 3, 2004 to Harvey) teaches a flyable plastic airplane that is composed of an upper and lower half, each with a fuselage section, left and right wing sections and left and right horizontal tail sections connected to the fuselage, a motor driven propeller and landing gear on the fuselage, and with no internal support or film covering and no external film for fuselage. U.S. Design Pat. D-260,787 (Sep. 15, 1981 to Tanaka) is a simulative kite with flat wings and a hollow body. U.S. Design Pat. D-469,144S (Jan. 21, 2003 to Greenberg) is an aquatic diving toy with flat wings.

It has been a problem to construct a device that would allow sufficient rigidity for gliding but still maintain enough flexibility and strength for good performance, aerodynamic qualities, and reliability or life expectancy. Low cost prior art designs often lack the ability to maintain flight properties after the initial use or after a small number of uses and lack any resemblance to real gliders, airplanes or winged creatures. Another problem has been the need to readjust the shape after landings. Higher cost gliders/airplanes are constructed using techniques common to the aircraft industry employing internal spars or bracing made from balsa or plastic to form a body with an outer skin consisting of paper, fabric or some type of polymer and are usually fragile in construction. The present invention solves these problems by the use of a simple internal ballast open to the atmosphere and an externally formed flexible fuselage.

SUMMARY OF THE INVENTION

The present invention provides a toy glider that is low cost, flexible and durable while maintaining desirable flight characteristics. The glider of the present invention is a hollow shell made from a molded thin film material. The glider can be formed into a variety of different shapes. Typically the glider is formed in the shape of a bird or a plane. The body of the glider comprises a hollow fuselage, a left wing and a right wing extending laterally from the fuselage, a ballast weight and a stiffener. The interior of the glider is open to the outside atmosphere and requires no inflation.

Previous gliders in the art have moveable components, such as the wings or the tail, to prevent damage to the glider in a crash. However, this requires the components to be reset after each flight. In the present invention the wings and body are welded together into one piece. The body of the glider comprises an upper body half and a lower body half that form the fuselage and wings when joined together. The upper body half is a single solid piece of molded film and forms the upper half of the fuselage and the upper half of the left and right wing. Likewise, the lower body half is also a single solid piece of molded film and forms the lower half of the fuselage and the lower half of the left and right wing. The upper body half is placed on top of the lower body half and the two halves are joined around their perimeters by means known in the art. The place where the upper body half and lower body half meet form a seam around the perimeter of the glider body when the halves are welded together. The left and right wing form a continuous structure with the fuselage.

The fuselage is an elongated hollow shaft having a forward end and a back end. As used herein, the length of the glider refers to the distance between the forward end of the glider and the back end. The width of the glider refers to the distance from the tip of one wing to the tip of the opposite wing, where the tip represents the point of the wing furthest away from the fuselage. As referred to herein, it is assumed the glider is oriented so that the length of the fuselage and width of the glider are horizontal.

The wings extend laterally from the fuselage of the glider. Each wing is hollow and has a leading edge and a trailing edge. The wings may be straight, curved, or straight at some portions and curved at other portions. In one embodiment, the wings are straight and perpendicular to the length of the fuselage. In another embodiment, the wings of the glider are delta wings. Alternatively, the wings are curved and swept back so that the tips of the wings extend toward the back end of the fuselage.

The wings have a leading edge and trailing edge extending from the fuselage to the tip of the wing. The leading edge is the edge closest to the forward end of the fuselage, and the trailing edge is the edge closest to the back end of the fuselage. The leading edge and trailing edge may be level with one another, or the leading edge may be higher than the trailing edge. The wings may be flat as they extend from the fuselage, or the height of the wings may vary. Wing profiles that are available for use with the present invention include, but are not limited to, those illustrated in "Model Aircraft Aerodynamics" by Martin Simons (Argus Books, 1994). In one embodiment, the wings have a profile where the height of the wing is highest at or near the point where the wing joins the fuselage and decreases toward the tip of the wing. In a further embodiment, the height of the wing is highest at or near the point where the wing joins the fuselage, decreases toward the center of the wing, and curves upward at the tip of the wing.

The stiffness and flexibility of the wings is variable from the fuselage to the wingtip. Preferably, the degree of stiffness and flexibility is graduated along the wing. The wings are semi-rigid with a higher degree of rigidity closer to the fuselage while the tips of the wings are flexible. Additionally, the leading edge of the wing, or a portion thereof, is more rigid than the trailing edge. The flexibility of the wing improves flight stability by allowing the glider to adjust to outside forces, such as wind speed and direction. The stiffness of the wings can be achieved through use of thicker or thinner materials to form the wings, or through the use of a stiffener or additional material in the interior of the glider body at the fuselage/wing area.

The thin film material that forms the glider body can be any material that is lightweight, durable, semi-flexible, semi-rigid, strong and able to hold its form while not readily accepting a crease. The gliders of the present invention can be thrown a large number of times with little to no damage to the glider or loss of flight characteristics. Preferably, the material also is translucent or transparent with good clarity. The material is optionally painted, printed or otherwise colored for decoration. Materials suitable for use in the present invention include, but are not limited to, Surlyn® (an ionomer of polyethylene and acrylic commonly used in packaging), polyvinyl chloride (PVC), acetate, acrylic, rubber, plastic, multiplayer films and mixtures thereof. Preferably, the thin film material is Surlyn®.

The thin film material that forms the glider body has a thickness between about 2 mils and about 15 mils. Because less weight results in increased flight time in typical glider designs, this lightweight construction is advantageous for extended glider flight. More preferably, the thin film material has a thickness between about 3 mils and about 10 mils. A mil is a unit of length equal to one thousandth ($10^{-3}$) of an inch (0.0254 millimeter), used, for example, to specify the diameter of wire or the thickness of materials sold in sheets. In one embodiment of the invention, the thin film forming the glider body has a thickness of approximately 3 mils. In another embodiment, the thin film has a thickness of approximately 10 mils.

The glider may optionally contain an internal skeleton to provide additional support. The internal skeleton is generally T-shaped or follows the same shape of the glider body. The interior skeleton can be any size within the dimensions of the glider body. Preferably, the interior skeleton covers a small area of the fuselage and wings near the front end of the fuselage and leading edge of the wings. In one embodiment the internal skeleton is constructed from a thin film material, preferably Surlyn®, approximately 10 mil thick and approximately ¾ inches in width at the leading edge of the wings. The internal skeleton can be vacuumed formed into the same shape as the glider body. Optionally, the internal skeleton is made from two or more layers of a thin film material stacked on top of another. Polyethylene foam, die cut from sheets or foam beads heat pressed into the desired shape, may also be used for the interior skeleton.

The glider further comprises a ballast weight and a stiffener that are encapsulated by the glider body. The ballast weight is any weight or material used to provide the necessary weight and weight distribution to enhance the flight characteristics of the glider. Materials suitable for use as the ballast weight include, but are not limited to plastic, metal (such as steel), plaster and hot melt plastic. The ballast is positioned at or near the front end of the fuselage. The ballast can be welded to the interior of the glider body or attached to an interior skeleton using hot melt plastic pins. Preferably, the ballast is not set in the front tip of the fuselage so that during a collision between the glider and an object, the front end of the fuselage will be soft, compressible and not damage the object struck by the glider. In one embodiment, the ballast weight is a piece of metal, such as one or more metal washers, located in the fuselage between the upper body half and lower body half.

The stiffener is a piece of material, including but not limited to, plastic, especially hot melt plastic, polyester, rubber or wood. The stiffener extends from the fuselage into each wing and provides support and some degree of rigidity to the wings. Additionally, the stiffener limits or prevents the wings from folding up or down along side of the fuselage and keeps the wings in a horizontal position. The stiffener may extend from the fuselage all the way to the tip of each wing. Alternatively, the stiffener only extends part of the distance between the fuselage and wingtip. In one embodiment, the stiffener extends ⅓, or less, of the distance between the fuselage and wingtip. Optionally, the stiffener is T shaped and also extends a certain distance along the length the fuselage. The stiffener may be directly attached, by means known in the art, to the interior of the glider body. Alternatively, the stiffener may be attached to the internal skeleton.

The present invention also provides methods of making gliders described herein. The thin film material is thermoformed over a mold using heat and a vacuum. The mold impression becomes permanent in the surface of the film when cooled. In one embodiment of the present invention, the upper body half and lower body half are formed from molds, fitted together, and bonded together using a heat seal and cut method, which involves an electrical resistance wire made from nichrome covered with Teflon tape and pressed against a Teflon covered silicon rubber surface. The upper body half and lower body half may also be joined using other means known in the art, including but not limited to, ultrasonic welding or adhesive materials.

Or, the model may be fabricated using injection-molding techniques. The ballast and the wing stiffeners would be attached to recessed areas under the wing and body. The stiffening members and the ballast would be welded or 'staked' to the body's undercarriage. The advantages of an injection molding process include: higher manufacturing volume, less material waste and improved product consistency. Disadvantages include: high initial tooling cost and the final appearance is not pristine. Although hidden by recesses, the ballast and the stiffeners will be visible on the models underside. Specifically, the injection molding process may be a blow molding process, which is a technique, used to make plastic bottles.

DETAILED DESCRIPTION OF THE INVENTION

Figure 1:
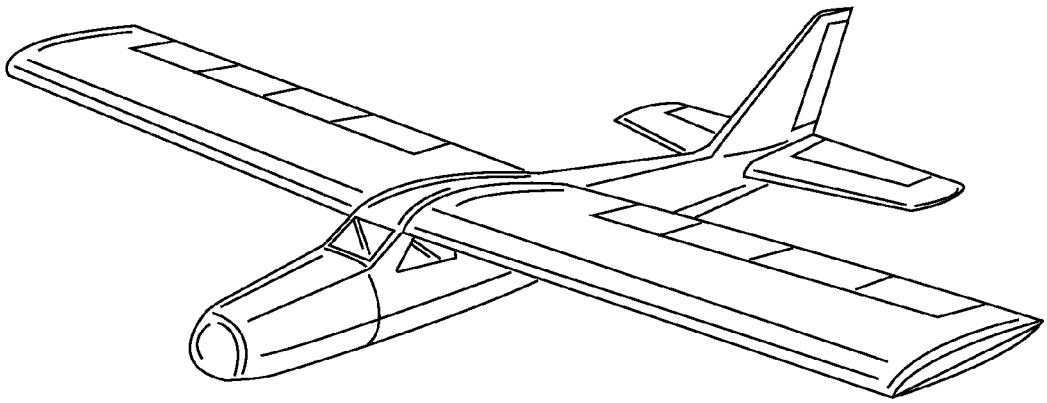
FIG. 1 illustrates a typical design of a plane or toy glider in the shape of a plane.

One embodiment of the present invention is a glider in the shape of a bird consisting of an upper body half and a lower body half which are sealed together by methods such as heat-sealing, ultrasonic welding, or adhesives. Film thickness can vary for the upper and lower body halves in the range of about 2-10 mils depending on design requirements. The internal skeleton, ballast and stiffener are bonded into an inner sub-assembly and welded to either the upper body half, lower body half, or both. Designs without an internal skeleton can be incorporated using only the ballast and stiffener, which can be of various lengths along the wings.

In embodiments utilizing an internal skeleton, the glider will consist of an upper body half and a lower body half with the internal skeleton placed between the two halves. The upper and lower body half have wing sections and a fuselage section. The internal skeleton is generally T-shaped, rigid or semi-rigid, and provides a degree of rigidity to the wing sections and fuselage sections. The internal skeleton, ballast weight and stiffener provide the best weight distribution to enhance the flying characteristics of glider. The present invention is not limited in scope by the size or by the shape of a stiffener, ballast or internal skeleton design. The upper body half and lower body half can be spot welded or joined to the interior skeleton and ballast by mechanical bonds.

The tips of the wings are inherently flexible, which improves flight stability in addition to increasing the durability of the glider. Gliders typically fly best with rigid or semi-rigid wings. The present invention provides wings that are semi-rigid at the leading edge or near the fuselage but with no interior bracing at the outer part of the wings, resulting in a flexible wingtip and improved flight stability.

The glider of the present invention has a mass between 5 grams and several pounds. Preferably the glider has a mass between about 10 grams and about 50 grams. More preferably, the glider has a mass between about 20 grams and about 40 grams.

The length of the fuselage can be up to 4 feet in length. Preferably, the length of the fuselage is between about 3 inches and about 3 feet. More preferably, the length of the fuselage is between about 5 inches and about 12 inches. The wingspan (the distance from wingtip to wingtip) is between about 6 inches and about 6 feet, preferably between about 8 inches and about 18 inches.

In one embodiment of the present invention, the glider is in the shape of a bird having swept back wings, where the body is 3 mils thick, made from Surlyn®, and has a mass of approximately 20 grams. This embodiment further comprises an interior skeleton made from 10 mil thick Surlyn®. In a slightly larger embodiment, the glider body is 10 mils thick and has a mass between about 34 and about 37 grams. It should be noted that although the present invention has been depicted with a bird shaped glider, the invention is not limited in shape or limited in design attributes.

Often the thin film material is produced by the manufacturer to have one side chemically or physically treated. For example, Surlyn® is available from the manufacturer where one side is corona treated. When the corona treated sides of the thin film material are mated together, they will not easily weld together. To weld an upper body half and lower body half that have been corona treated, the two pieces are placed in a clamshell mold with the treated surfaces facing away from each other. A hot wire is then used to cut and seal the two halves together.

The interior skin or skeleton is also cut and joined to the glider body using the heat and seal process. Where the interior skeleton is made from one or more layers of a thin film material, one side of each layer may be corona treated. In one embodiment, the interior skeleton is made from two layers of 10 mil Surlyn® that has been coated with an adhesive on the corona treated surface (available from HS & Associates, Canoga Park, Calif.). The two layers are mated so that the sides having the adhesive are pressed together. The untreated sides of the skeleton are then welded to the interior surface of the glider body.

In one embodiment, the stiffener is attached to the interior skeleton by first punching holes in the interior skeleton and placing the stiffener against the interior skeleton. Hot melt adhesive is then melted over the hole to form a mechanical bond through the hole in the interior skeleton with the stiffener. Alternatively, the stiffener may be stapled to the interior skeleton before the interior skeleton is attached to the interior of the glider body.

One or more holes, slits, or other openings may be present in the glider body exposing the interior of the glider to the outside atmosphere. The glider of the present invention does not require internal air pressure to maintain its form or flight characteristics and is not inflated. Air leaking from the interior of the glider body is not a concern. The openings can improve the airflow around and through the glider. Furthermore, the openings allow the glider body to compress during a collision or if stepped on, where an inflatable glider would burst.

Figure 2:
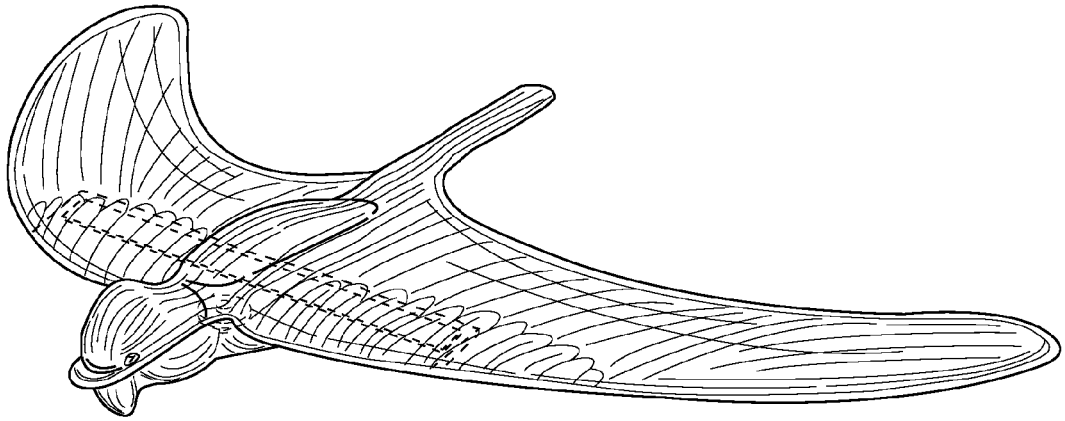
FIG. 2 illustrates a bird shaped glider of one embodiment of the present invention.

FIG. 1 shows a glider having a typical plane design. Gliders of the present invention can have any shape including plane or bird designs provided that the fuselage and wings are hollow and are open to the atmosphere. FIG. 2 shows one embodiment of the present invention where the glider is in the shape of a bird having swept back wings.

Figure 3:
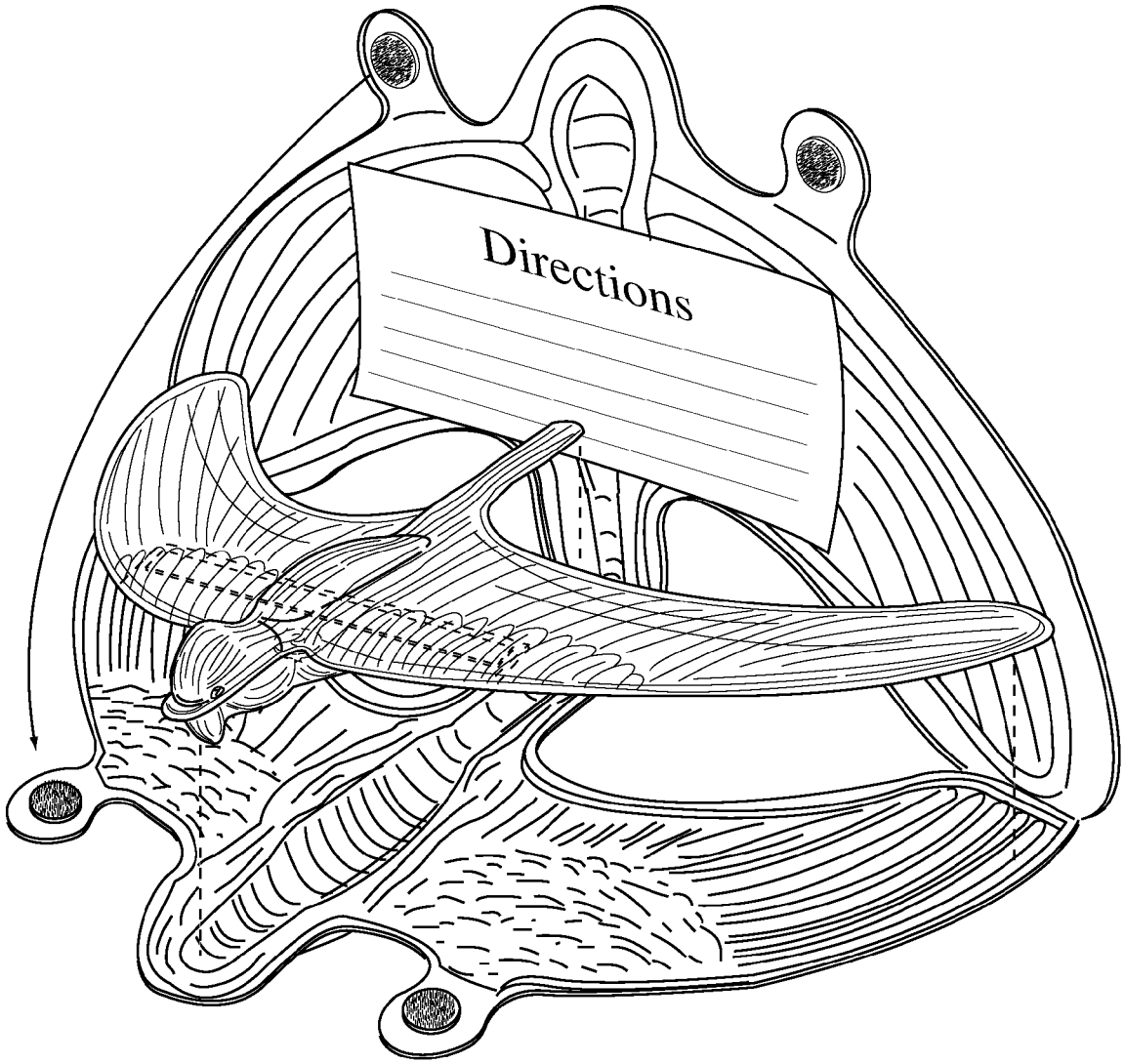
FIG. 3 shows the bird shape glider of FIG. 2 adjacent to a storage shell of the present invention, where the interior contours of the storage shell match the size and shape of the glider.

The glider body will distort if a weight is placed on the wing or fuselage, or if the glider is stored in a bent or awkward position. Flight characteristics may degrade without appropriate storage. A storage shell is a rigid tight fitting clam shell with top and bottom halves where the ideal wing configuration is molded into the shell. FIG. 3 shows the glider of FIG. 2 in relation to a storage shell, where the interior of the storage shell is made to match the size and shape of the glider. Preferably, the storage shell is made from a rigid or semi-rigid material. In one embodiment, the material is 12 mil thick thermoformed polyvinyl chloride. The glider is placed in the shell, which allows the glider to conform to the wing contour formed into the rigid plastic shell. The glider is secured to the nest with rubber bands or plastic tabs or Velcro tabs. As shown in FIG. 3, directions for storing or flying the glider can be posted on the inside of the storage shell. Flight properties are improved when the shell is used to store the glider when it is not in use. The glider resorts to its original shape over time when placed inside the shell.

Figure 4:
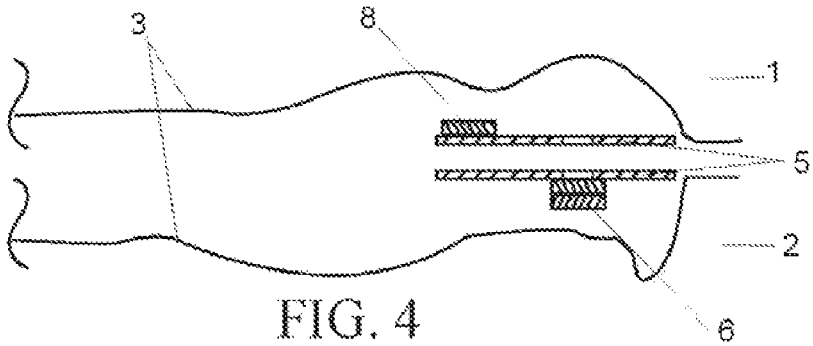
FIG. 4 is a side view of a bird shaped glider of the present invention.

FIG. 4 shows a side view of a bird shaped glider of the embodiment where the upper body half 1 and lower body half 2 are made of a 10 mil Surlyn® film thermoformed into a bird shape. For lighter gliders, the glider can be made from 3 mil film. A stiffener 8 comprising a polyester plastic strip is attached to the two internal layers or support films 5 by one or more staples or other means. The polyester strip is approximately 21 mils thick and has a width of 7/16 inches. The internal layers or support films 5 are also 10 mil films and optionally at least one side is coated with adhesive. The ballast 6, comprising a stack of ¼ inch steel washers, is also attached to the two internal film layers or support films 5.

The internal film layers 5 are Surlyn® coated with an adhesive on one side of each layer. This material is typically used in skin packing where the Surlyn® film is glued to 'untreated' cardboard, (glue side down onto the cardboard). The adhesive on one film layer must be mated with the opposite adhesive coated surface for a good bond. A ¼ inch hole is punched into the two internal film layers 5 in the neck/head area of the glider. The washers, which form the ballast 6, are attached to the film using 'hot melt adhesive,' which is formed into a plastic bolt. Optionally, the ballast 6 can be positioned near the front or head of the glider, as shown in FIG. 4, or along the body of the glider.

Figure 5:
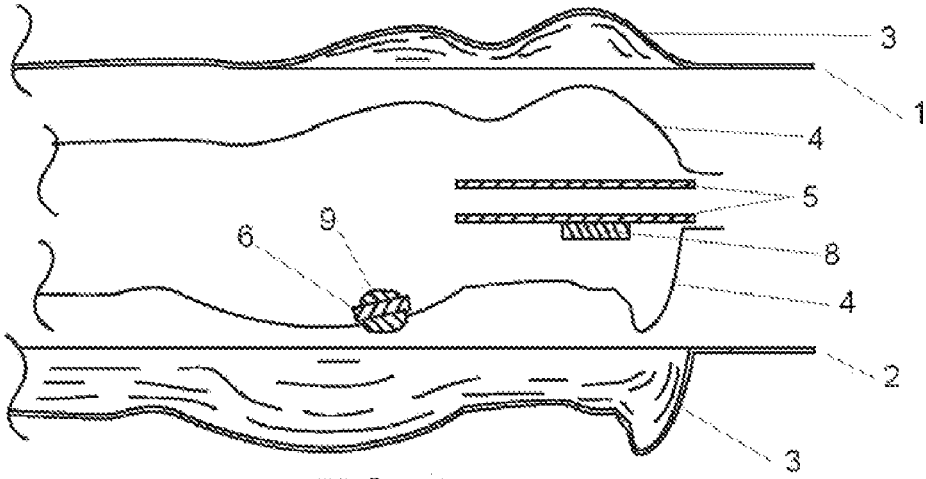
FIG. 5 is an exploded side view of a bird shaped glider in one embodiment of the present invention where the internal skeleton is in the same shape as the glider body and extends along the fuselage.

FIG. 5 is an exploded side view of a bird-shaped glider where the ballast 6 is located near the middle of the glider instead of near the head. Additionally this glider has an internal skeleton 4 in the shape of the glider body that extends toward the back end of the fuselage and along the wings. The internal skeleton provides additional support to the glider body. Ballast 6 is attached to internal skeleton 4 by a hot melt adhesive, which is formed into a plastic bolt 9. Gliders having interior skeletons 4 may also have the ballast 6 positioned at the head or along the body of the glider. Preferably the internal skeleton 4 matches the contour of the upper body half 1 and lower body half 2. In one embodiment, the outer skin of the upper body half 1 and lower body half 2 are made from 3 mil film while the internal skeleton is made from 10 mil film. In a heavier version of the glider, both the outer skin of the upper body half 1 and lower body half 2 and the interior skeleton are made from 10 mil film.

Figure 6:
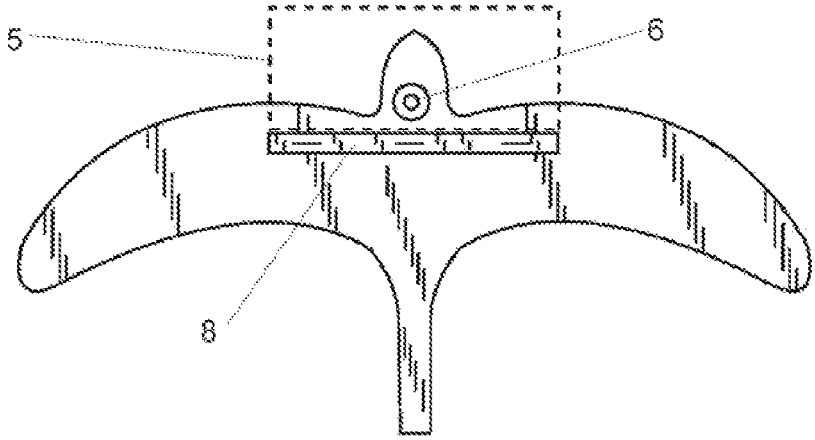
FIG. 6 is a top view of a bird shaped glider having polyester strip across the fuselage.
Figure 7:
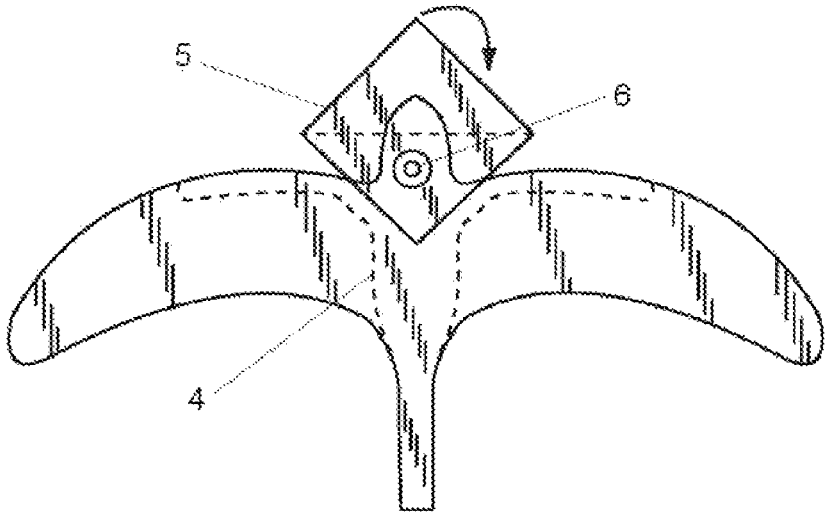
FIG. 7 is a top view of a bird shaped glider having an interior skeleton.

FIG. 6 is a top view of a glider showing a stiffener 8 extending across the fuselage into each wing. The stiffener 8 and ballast 6 are attached to the internal film layers 5 (represented by the dotted line). Similarly, FIG. 7 is a top view of a glider having an interior skeleton 4 (represented by the dotted line along the fuselage and leading edge of the wings). The ballast 6 is attached to the internal film layers 5 which are formed from a diagonal film folded in half. As shown in FIG. 7, the interior skeleton 4 extends toward the back of the fuselage and along the leading edge of the wings. Optionally, the interior skeleton 4 may extend throughout the entire glider, or extend along the entire fuselage and the entire area of the wings except for the tips. By not having the interior skeleton 4 extend into the tips of the wings, the tips of the wings will have additional flexibility. In one embodiment, a heavy duty glider comprises an outer skin made from 10 mil film and an interior skeleton, also made from 10 mil film, which extends along the entire length of the glider except for the tips of the wings.

Figure 8:
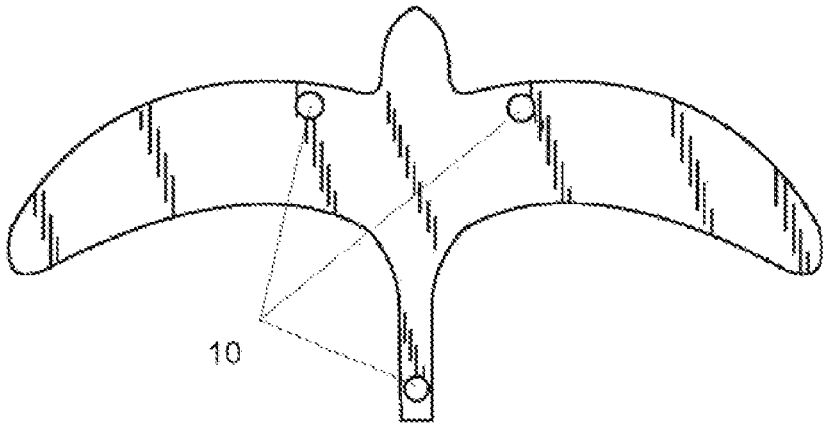
FIGS. 8 and 9 are top views of a glider having holes in different positions in the body exposing the interior of the glider to the outside atmosphere.
Figure 9:
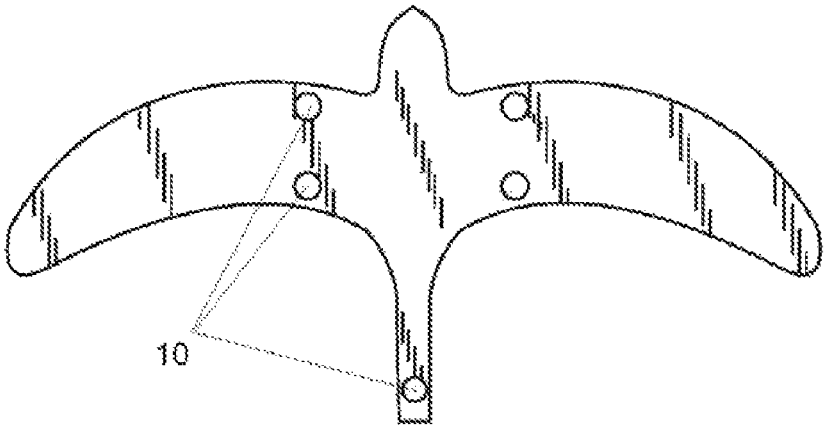

FIGS. 8 and 9 show a bird-shaped glider of the present invention having holes 10 punched through the outer skin of the glider body. The holes 10 allow airflow into the interior of the glider body, reducing the speed of the glider but increasing the stability of the glider. The holes 10 may be punched into the top skin or bottom skin or combinations of both. FIG. 8 shows a glider having three holes 10, and FIG. 9 shows an additional configuration where five holes 10 are present.

Figure 10A:
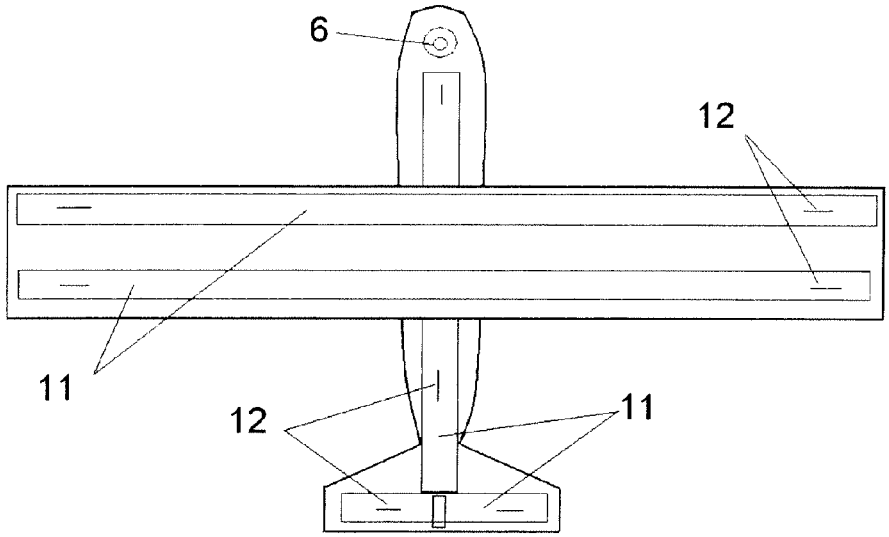
FIGS. 10A and 10B show an airplane glider having multiple polyester strips across the wing and fuselage for support.
Figure 10B:
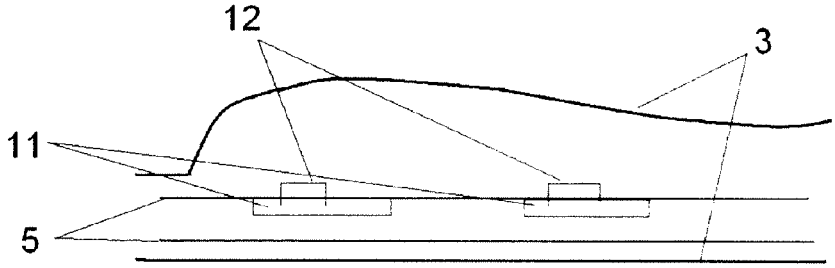

FIGS. 10A and 10B show a top view and wing cross section of an airplane glider. The glider has multiple polyester strips 11 across the wing and fuselage for support. The polyester strips 11 reduce the flexibility in the wings and body and can be attached using staples 12 or other means known in the art. Other plastics and rigid foams, such as closed cell polyethylene, may alternatives to polyester. Multiple strips made from polyester or similar materials may be used on other gliders of the present invention to improve the stability of the glider.

Figure 11A:
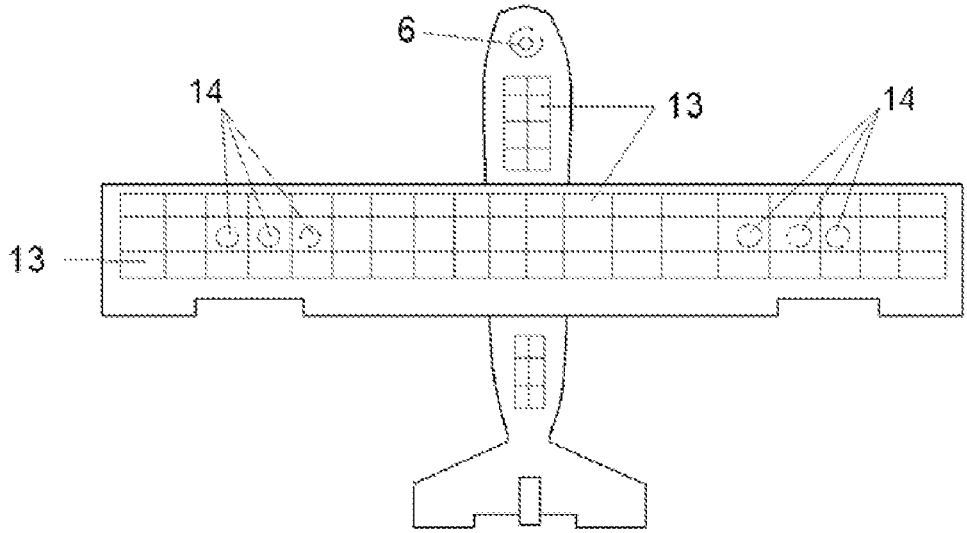
FIGS. 11A and 11B show an airplane glider with waffle interior bracing.
Figure 11B:
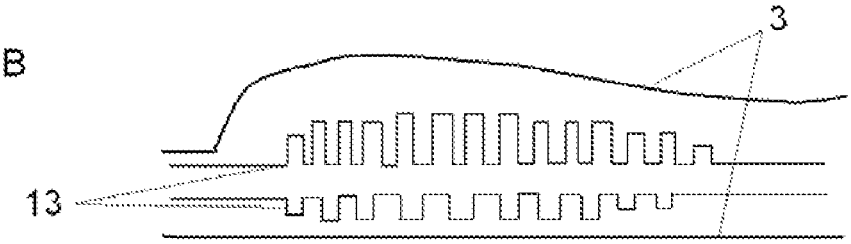

Similarly, FIGS. 11A and 11B show a top view and wing cross section of an airplane glider having a waffle interior bracing 13 formed by the interior support film. The waffle bracing 13 may also be used in different gliders of the present invention, and may be combined with one or polyester strips to provide support to the glider. Optional bracing cutouts 14 cut into the waffle bracing may be advantageous to reduce the weight of the glider or portions of the glider. Although the bracing cutouts 14 are depicted in FIG. 11A as circular holes, they can be any shape. Existing motorized planes usually require a quick release to detach the wing from the body of the plane during a crash. However, in the present invention, since the airplane's skin and internal structures are tough and somewhat flexible, the wing surfaces may be molded permanently to the body. Moving wing surfaces, such as ailerons and elevators, may be cutout from the body or constructed from thin solid strips of plastic.

In another embodiment, a glider has a T-shaped stiffener that extends from the front end of the fuselage to the back end, and also extends from the fuselage close to the tip of the wings. The stiffener is constructed from two strips of polyester stapled together. The stiffener is attached to the glider body by a staple at the perimeter in the bird's head and shoulder region. In one embodiment, the glider can function as a kite. Holes at the head, tail and wings of the glider are punched thought the bottom portion of the bird's outer skin and a line is threaded through to the polyester stiffener.

Another embodiment of the present invention is a glider where the stiffener is V-shaped, which is created with a plastic angle made from a clear butyrate piece. The angle of the stiffener causes the angle of the wings to be more pronounced, i.e. have a greater height near the fuselage. Staples secure the internal skeleton, the stiffener, and the plastic piece, together. A hole in the center of the glider body allows a thread or a line to attach to internal skeleton. In one embodiment, the glider can be suspended by the thread or line and functions as a mobile. Ballast is used to balance the weight of the glider in order to keep the glider level while suspended.

One process of fabricating the glider of the present invention starts by selecting each section film to be colorized or design colorized. Then heating sections of the thermoplastic film to be thermo-formed over a mold are selected. The next step consists of thermoforming each piece of film over molds using heat and vacuum. During this process the film is stretched and, by employing either male or female molds, film thickness may be reduced or thickened, also texture can be ingrained into the film. Thickness variation would allow specific sections to have more strength or to have either more or less rigidity. Then each respective piece of film is cooled. When cooled, the mold impressions become permanent in the films surface. Colorization and texturing of the film can be used to highlight the design; a bird glider thus would have a texture on the wings to represent feathers, for example. Next, it is determined if the outer structure is to be double film. If so, then two previously thermoformed films are fit together and welded via a vacuum seal and cut method to form each upper and lower section. The welding process of the preferred embodiment of the present invention consists of placing the film, (corona side out), into a clamshell mold and using a hot wire to cut and weld the two film surfaces together. If the film is not double thickness, proceed directly to the next step where the interior pre-assembled fuselage is placed between the upper and lower half sections. The interior fuselage is then spot welded to the lower (or upper or both) half section. Then the upper and lower sections are bonded together via the heat seal and cut method to form the finished glider.

The fabrication steps would vary somewhat according to the design. For example a bi-plane or other designs may have upper and lower sections, and a separate fuselage. The present invention is not limited to any specific design. It should be noted that indoor and outdoor designs can be optimized individually, or a design for both indoor/outdoor use can be designed. For example an outdoor design can employ interior 10-mil upper and lower film over the entire body and wing area. Since flexing wing tips improves flight stability on an indoor glider, wing tips, where the interior film is shortened at the wing tips, leave the tip area with only a 10-mil total outer skin. A larger ballast, and or cross member will increase a gliders weight and, along with a thicker skin, will result in a glider with increased strength and toughness as compared to an indoor model. An indoor design can employ 3-mil film on the upper and lower sections with a 3-mil film interior skeleton resulting in lightweight to minimize any damage to indoor furnishings. It should be noted that material thickness or combinations of material thickness and/or selection of material type do not limit the scope of the present invention. It may be desirable to have weights of an outdoor model to be in the range of about 30-50 grams whereas an indoor model may have weights in the range of about 12-30 grams. Dimensions of different planes and gliders are shown in Table 1, with different gliders of the present invention presented in bold.

Table 1 compares the gliders of the present invention to various gliders and powered planes. The planes vary in cost from one dollar to over a thousand dollars. Surprisingly, all the gliders and planes, (from simplest to most complex), can be compared by weight, wing span, wing surface area and wing 'load.'

Wing Load

The data is arranged by 'load' capacity of the flyer, (weight/wing area). This factor is described in nesail.com, (a model airplane vendor), and the load is measured in oz./sq.ft. In practice, the glider or planes speed is influenced by this load ratio. The lower the load number, the slower the glider. Weighty, powered planes, (high load numbers), require significant speed to remain airworthy.

Wing Cross Section

Another flight factor, which is not compared in Table 1, is wing cross section. The 19 models in Table 1 may have flat wings or high lift cross-sections and the different wing

TABLE 1

Glider and Plane calculations

| | Model | Key | span inches | wing area sq. inch | weight oz. | pounds | weight calc oz. | weight grams | wing/body ratio | load calc oz./sq. ft. |
|---|---|---|---|---|---|---|---|---|---|---|
| 1 | Air Surfer | Hl | 17 | 50 | | | 0.123 | 3.5 | 5.7 | **0.4** |
| 2 | Lyonaeec | Rb | 12 | 35 | | | 0.433 | 12.3 | 1.3 | **1.8** |
| 3 | Styro glider | Hl | 24 | 96 | | | 1.233 | 35.0 | 1.3 | **1.9** |
| **4** | **bird, 20** | **Hl** | **17** | **51.3** | | | **0.705** | **20.0** | **1.9** | **2.0** |
| 5 | E Charger | Em | 9.75 | 40 | | | 0.599 | 17.0 | 1.2 | **2.2** |
| 6 | Airforce one | El | 10.5 | 22 | | | 0.345 | 9.8 | 0.95 | **2.3** |
| 7 | Stunt monster | Hl | 8 | 24 | | | 0.430 | 12.2 | 1.1 | **2.6** |
| **8** | **bird, 31** | **Hl** | **17** | **51.3** | | | **1.093** | **31.0** | **1.9** | **3.1** |
| **9** | **bird, 35** | **Hl** | **17** | **51.3** | | | **1.233** | **35.0** | **1.9** | **3.5** |
| 10 | Logic | Hl | 59 | 355 | 8.5 | 0.5 | | 241.2 | | **3.5** |
| 11 | Zagi THL | Hl | 48 | 407 | 11.5 | 0.7 | | 326.3 | | **4** |
| 12 | Lucia DLG | Hl | 59 | 385 | 11 | 0.7 | | 312.1 | | **4.5** |
| 13 | Storm | Hl | 7 | 16 | | | 0.634 | 18.0 | 1 | **5.7** |
| 14 | Stinger | Em | 37.5 | 215 | 16 | 1.0 | | 454.0 | | **10.5** |
| 15 | Kabriolin | G | 55 | 830 | 52 | 3.3 | | 1475.5 | | **12.0** |
| 16 | Rebelove | G | 61.5 | 1084 | 100 | 6.3 | | 2837.5 | | **13.0** |
| 17 | Razzia | G | 76.5 | 1566 | 160 | 10.0 | | 4540.0 | | **14.0** |
| 18 | Kulbutin | Em | 71 | 620 | 72 | 4.5 | | 2043.0 | | **17.0** |
| 19 | Fredy E | Em | 60 | 320 | 18 | 1.1 | | 510.8 | | **18.0** |

| Key | abrev. |
|---|---|
| glider, hand launch | Hl |
| rubber band | Rb |
| electric motor | Em |
| gas engine | G |
| elastic launch | El |

How load calculations were derived, (oz./sq. ft.)

| | |
|---|---|
| measured models | 1 thru 9, 13 |
| **Measured** | **4, 8, 9** |
| nesail.com | 10, 11, 12, 14 thru 19 |

| Gliders of the present invention | Ranges (based on existing flyers and planes) |
|---|---|
| Weight | 3 grams-25 lbs. |
| wing span | 5 in.-12 ft. |
| wing area | 10 sq. in.-35 sq. ft. |
| load, oz./sq. ft. | 0.4-35 oz./sq. ft. |
| wing/body ratio | 0.5-12 |

designs would influence the glider or planes flight characteristics. There are multitudes of wing cross sections and my fabrication technique would work with any of them. See "Model Aircraft Aerodynamics" by Martin Simons (Argus Books, 1994).

Ranges for the Gliders of the Present Invention

The gliders of one embodiment of the present invention may be summarized in the following chart, based on the gliders and comparing them to existing gliders and planes. The gliders would fall within these parameters:

| Present Invention | Ranges |
|---|---|
| Weight | 3 grams-25 lbs. |
| wing span | 5 in.-12 ft. |
| wing area | 10 sq. in.-35 sq. ft. |
| load, oz./sq.ft. | 0.4-35 oz./sq. ft. |
| wing/body ratio | 0.5-12 |

Depending on the glider or planes size, weight is expressed in grams or pounds. Tip to tip wingspan is measured in inches or feet. The wing surface area is in square inches or square feet. The wing load is express in ounces per square foot. The wing to body ration is a calculation of the wingspan divided by the body length. In a conventional airplane, this ratio is around 1. A flying wing, such as Air Surfer, (1.), or Zagi THL, (12.), may have no body and so the wing to body ratio can be considered to be around 6.

The thin film material used to make the surface of the gliders may be colored using permanent ink markers or inks typically used for polyethylene films. Inks are commonly printed onto polypropylene, polyethylene shopping bags. However, when these bags are handled with normal sweat or hand oil, over time the ink transfers onto the users hand. This is unacceptable for the toy glider.

Using a permanent marker on the inside of the glider surface eliminates the ink transfer to the hand, but ink or markers significantly weaken the seal bond strength, so the bonding seam should not be inked. Alternatively, the ink is laminated between two sheets of Surlyn® attached to the interior of the glider. Laminated film can be sealed and cut using an electrically heated nichrome wire with pressure allowing the entire model, (up to and including the bond line), to be painted. As an alternative, exterior ink that does not transfer to the skin or other surfaces can be used. Optionally, the glider is constructed with one or more thin pieces of colored or decorated material, such as cellophane or other type of plastic film, within the interior of the glider. The one or more pieces of colored material can be attached to the top half and/or bottom half of the glider interior using an adhesive. Additionally, one or more pieces can be thermoformed to match the shape and size of the top half or bottom half of the glider body. The use of colored plastic film or cellophane to decorate the glider is typically easier and cheaper than using inks.

The models may also display numerous cosmetic features attached to the flying model such as streamers. With addition of electronics and a small battery, blinking lights and various electronic sounds like chirping, music, engine sound, etc are also possible. A motion-detecting switch may activate the visual and auditory displays. While at rest, the functions would turn off to save the battery.

While the invention has been described with certain preferred embodiments, it is understood that the preceding description is not intended to limit the scope of the invention. It will be appreciated by one skilled in the art that various equivalents and modifications can be made to the invention shown in the specific embodiments without departing from the spirit and scope of the invention. All publications referred to herein are incorporated herein to the extent not inconsistent herewith.

What is claimed:

1. A glider comprising:

(a) a glider body formed by a top body half, comprising the top of a fuselage, left wing and right wing, attached to a lower body half, comprising the bottom of the fuselage, left wing and right wing; wherein the formed glider body comprises:

(i) a hollow fuselage; and (ii) a left wing and a right wing extending laterally from the fuselage, wherein each wing is hollow and has a leading edge and a trailing edge;

wherein said glider body is made from a thin film material and the interior of said glider body is open to the outside atmosphere;

(b) a ballast weight encapsulated by said glider body;

(c) a stiffener encapsulated by said glider body, where said stiffener extends from one wing through said fuselage to the other wing; and (d) an internal skeleton encapsulated by said glider body, wherein said internal skeleton comprises one or more layers of a second thin film material.

2. The glider of claim 1 wherein the length of said fuselage is between about 3 inches and about 3 feet.

3. The glider of claim 2 wherein the length of said fuselage is between about 5 inches and about 12 inches.

4. The glider of claim 1 wherein the distance from wingtip to wingtip is between about 5 inches and about 6 feet.

5. The glider of claim 1 wherein the distance from wingtip to wingtip is between about 6 inches and about 18 inches.

6. The glider of claim 1 wherein said thin film material has a thickness between about 2 mils and about 15 mils.

7. The glider of claim 6 wherein said thin film material has a thickness between about 3 mils and about 10 mils.

8. The glider of claim 1 wherein said glider has a mass between about 10 grams and about 50 grams.

9. The glider of claim 8 wherein said glider has a mass between about 20 grams and about 40 grams.

10. The glider of claim 1 wherein the area of the wings closest to the fuselage is semi-rigid and the area of the wings furthest from the fuselage is flexible.

11. The glider of claim 1 wherein said thin film material is transparent.

12. The glider of claim 1 wherein said thin film material is Surlyn®, PVC, polyethylene, acetate, acrylic, plastic, PETG, polycarbonate, polypropylene, styrene butadiene styrene (SBS), styrene ethylene propylene styrene (SEPS), styrene butadiene (SB), ABS, polycarbonate, styrene isoprene styrene (SIS), multilayer films or mixtures thereof.

13. The glider of claim 12 wherein said thin film material is Surlyn®.

14. The glider of claim 1 where said second thin film material is Surlyn®.

15. The glider of claim 1 where said second thin film has a thickness of approximately 10 mils.

16. The glider of claim 1 further comprising one or more pieces of a thin colored material attached to the interior of the glider.

17. The glider of claim 16 wherein said one or more pieces are thermoformed to match the shape and size of the top body half or lower body half.

* * * * *